United States Patent [19]

Pennington et al.

[11] Patent Number: 4,961,908

[45] Date of Patent: Oct. 9, 1990

[54] COMPACT COMBUSTION APPARATUS

[75] Inventors: Rodney L. Pennington, Morris Township, Morris County; James H. Mueller, Morristown, both of N.J.

[73] Assignee: Regenerative Environmental Equip. Co., Morris Plains, N.J.

[21] Appl. No.: 119,110

[22] Filed: Nov. 10, 1987

[51] Int. Cl.[5] ..... B01D 53/34

[52] U.S. Cl. ..... 422/173; 110/203; 110/211; 422/175; 422/177; 422/182

[58] Field of Search ..... 422/173, 168, 169, 170, 422/171, 172, 175, 176, 177, 182; 110/203, 210, 211, 212, 213, 214; 431/5

[56] References Cited

U.S. PATENT DOCUMENTS

| | | | |
|---|---|---|---|
| 3,634,026 | 1/1972 | Kuechler . | |
| 3,895,918 | 7/1975 | Mueller . | |
| 4,248,841 | 2/1981 | Benedick . | |
| 4,252,070 | 2/1981 | Benedick . | |
| 4,263,259 | 4/1981 | Benedick . | |
| 4,267,152 | 5/1981 | Benedick . | |
| 4,302,426 | 11/1981 | Benedick . | |
| 4,426,360 | 1/1984 | Benedick . | |
| 4,474,118 | 10/1984 | Benedick . | |
| 4,544,526 | 10/1985 | Billings | 422/182 |
| 4,650,414 | 3/1987 | Grenfell | 422/175 |

*Primary Examiner*—Peter Kratz

*Attorney, Agent, or Firm*—Paul & Paul

[57] ABSTRACT

A combustion apparatus is provided, preferably of the thermal heat regeneration type, in which noxious or other gases are passed to an incineration chamber, to be burned at a sufficiently high temperature that they are disposed of. The apparatus is constructed as a compact unit, as essentially a single oven separated into a plurality of heat exchange sections, and with plenums therebeneath, fed by an inlet duct, and able to deliver the products of combustion to an outlet duct, both preferably disposed beneath the plenums, and preferably mounted on a common supporting frame for facilitating sufficient mounting of the apparatus, as well as ready transport of the same.

4 Claims, 2 Drawing Sheets

COMPACT COMBUSTION APPARATUS

BACKGROUND OF THE INVENTION

In prior art devices, and particularly those of the energy regeneration type, it has been known to bring contaminated fumes or odors into a combustion chamber for burning the same at a sufficiently high temperature that substantially all that is released into the atmosphere is carbon dioxide and water.

It has also been known that, in the passage of such gases into a combustion chamber, they can preferably and preliminarily pass through stoneware beds on their way to the combustion chamber, which stoneware beds have been preheated, so that they, in turn, can preheat the incoming gases so that combustion is assured as soon as the incoming gases pass into the combustion chamber. While generally, the principal combustion takes place in the combustion chamber, the gases can autoignite while still in the presence of the stoneware in the stoneware chambers if the gases contain volatile organic compounds. In any event, periodically, the flow, of gases is reversed, such that gases from the combustion chamber pass outwardly through the stoneware chamber, to preheat the same, as the products of combustion pass outwardly on their way to atmosphere. Generally such combustion processes alternate the flow through the recovery chambers on a regular basis.

An example of such a system is that which is disclosed in U.S. Pat. No. 3,895,918 issued to James H. Mueller on July 22, 1975, the complete disclosure of which is herein incorporated by reference.

Another example of a device incorporating thermal recovery principles is that said forth in U.S. Pat. No. 4,474,118, in which there is vertical flow through separate heat exchange sections that are separately constructed as individual units.

In many of today's manufacturing processes, and especially in order to meet air purification standards or the like imposed by government agencies, it is desirable to rapidly implement an incineration process and apparatus to purify exhaust gases. In doing so, the inherent delays caused by on-site construction may result in the failure to implement the necessary incineration apparatus on a desirable timetable, the inability to use or fully use the manufacturing equipment that produces the exhaust gases or in the dissipation of unpurified exhaust gases to atmosphere because of the inability to install a system in a timely matter.

SUMMARY OF THE INVENTION

The present invention is directed to an apparatus for incinerating industrial exhaust gases, on a thermal recovery principle, in which the apparatus is efficiently and compactly constructed, to facilitate rapid delivery to an installation at which it will be operated.

Accordingly, the present unit is efficiently constructed to have reduced thermal loss, by utilizing common separation walls for separating gas flow in the individual heat exchange sections. In some instances with the use of such common walls there will be less radiation to outside the unit, and thereby greater preservation of usable heat from one heat exchange section to the other, whereby the unit may be more compactly constructed. In other instances, as where the common wall is hollow, it may be used as an air preheater.

Additionally, the unit thus constructed may be made to have less weight than units with individually constructed heat exchange sections, and at a lower cost. Additionally, by the present invention, the incineration units may be compactly constructed to be supported on a common frame, that enables the units to be lifted and conveniently shipped in already-assembled condition to the situs of use.

Accordingly, it is a primary object of this invention to provide a novel apparatus for incinerating industrial exhaust gases on a thermal recovery principle, in which the apparatus is more compactly constructed.

It is a further object of this invention to provide a novel incineration apparatus for industrial exhaust gases, which operate on a thermal recovery principle, and in which the apparatus may be constructed as a portable unit, carried on a common supporting frame.

It is a further object of this invention to provide an apparatus for incinerating industrial exhaust gases on a thermal recovery principle, in which adjacent heat exchanged sections share a common flow separation wall.

Other objects and advantages of the present invention will be readily apparent to those skilled in the art from a reading of the following brief descriptions of the drawing figures, the detailed description of the preferred embodiment, and the appended claims.

BRIEF DESCRIPTIONS OF THE DRAWING FIGURES

DETAILED DESCRIPTION OF THE PREFERRED EMBODIMENT

Figure 1:
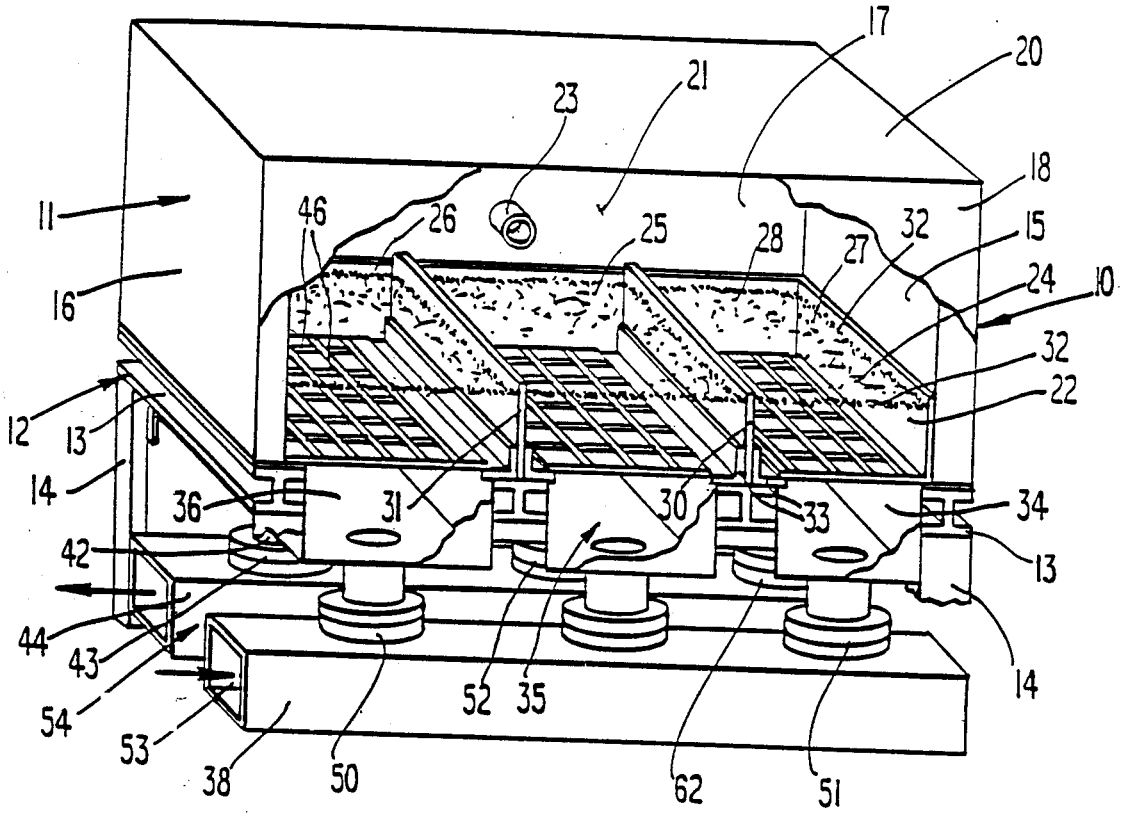
FIG. 1 is a top perspective view, partially broken away, of an incineration apparatus in accordance with this invention, in which adjacent heat exchange sections are separated by a common wall, and in which the apparatus is mounted on a common supporting frame.

Referring now to the drawings in detail, reference is first made to FIG. 1 wherein the apparatus of this invention is generally designated by the numeral 10. The apparatus 10 includes an oven 11 mounted on a supporting frame apparatus 12. The supporting frame apparatus 12 can take many formats or arrangements, but in the embodiment illustrated utilizes four "I" beams 13, generally arranged parallel to each other as illustrated, and connected at their ends by other beams (not shown) arranged perpendicular to the beams 13, one at the rear of the apparatus, hidden from view in FIG. 1, and one at the front of the apparatus, not shown because of the broken-away illustration provided at the front of the apparatus for the sake of clarity. The entire horizontal beam arrangement, is then supported by vertical legs 14 at each of the four corners of the frame arrangement, as illustrated, with the lower ends of the legs 14 resting on a floor, ground, or the like.

The oven 11 is shown carried on the upper ends of the "I" beams 13, as indicated in FIG. 1. The oven 11 is shown as having upstanding right and left end walls 15 and 16 and upstanding rear and front walls 17 and 18, with the upstanding walls being connected by a top wall 20. Preferably, all of the walls 15 through 20 are constructed of a refractory or ceramic fiber material, which provides a heat insulating effect for retaining heat inside the oven 11.

The oven 11 has, in its interior an upper portion 21 which functions as the combustion chamber for heating incoming gases up to temperatures of 2000° F. or more, by means of one or more burners of the oil or gas operated type 23 therein, and with the oven 11 also having a lower portion 22 that includes a plurality, preferably at least three heat exchange sections 24, 25 and 26, disposed in adjacent, straight line relationship, aligned with each other as shown. The heat exchange sections are preferably constructed as a single tray comprised of upstanding legs 27, 28 and similar left end and front legs, to complete the rectangular wall portions of the tray, with additional upstanding wall portions 30 and 31 comprising common separation walls, separating the adjacent ones of the heat exchange sections 24, 25 and 26, from each other physically, and especially from gas flow communication from one to the other. It will be understood that there can be any number of heat exchange sections, but preferably there will be an odd number, such as three, five, seven, etc. The upstanding peripheral walls of the tray, such as walls 27, 28 and the like are preferably constructed of metal such as steel, for heat retention purposes, and to provide structural rigidity and support for a large number of heat exchange elements disposed therein up to the level 32 at the upper end of the tray. Similarly, the separation walls 30 and 31 are preferably constructed of metal, such as steel, likewise for reasons of structural support of the heat exchange elements disposed therein, and also to provide common walls between the sections that will allow heat transmission between the sections, producing less thermal loss, and preventing heat radiation from a given section from passing to outside the oven, but rather going to an adjacent section. Alternatively, the walls 30 and 31 and even upstanding walls such as 27, 28 and the like, are made of nonmetallic construction, such as ceramic, masonry, or of other alternative materials.

The walls 30 and 31 are, in turn, supportably mounted in sandwiched relation between structural steel angle members 33, that, in turn, are carried on "I" beams 13.

The heat exchange elements that are disposed in the heat exchange sections 24, 25 and 26, may be of any suitable type, such as those disclosed in the above-mentioned U.S. Pat. No. 3,895,918.

Carried beneath the heat exchange sections 24, 25 and 26, are respectively associated plenums 34, 35 and 36 which receive incoming gases delivered via a blower or the like 37, through an inlet manifold 38, and into selected one or ones of the plenums 34, 35 or 36, via one or more valves 50, 41 or 51 in delivery manifold 38, for the flow of such incoming gases up through the associated plenum or plenums, upwardly through a heat exchange section or sections, for being preheated by means of heat from heat exchange elements contained within associated heat exchange sections, into the chamber 17, for combustion of the gases therein, followed by delivery of the gaseous products of combustion back downwardly through another adjacent heat exchange section and its associated plenum, and out through an outlet duct 42, 52 or 62, past an associated outlet valve such as 43, 49 or 48, to an outlet manifold duct 44, to discharge by means of being impelled by a suitable discharge blower 45 or the like. It will be understood that, generally, it will not be necessary to have air movement means, such as blowers 37 and 45, at both locations, in that the system can operate either with forced air at the inlet side, in which a blower or other suitable air moving means 37 can be provided, or the system can operate by means of an induced partial vacuum, in which case an air movement mean, such as a blower 45 or other air movement means can be used. However, in some instances it may be desirable to have air movement means both at the inlet and outlet locations. Additionally, it will be understood that the air movement means are described and illustrated as blowers only by reason of example, in that any types of fans, eduction devices, etc. may be used, including the absence of such devices, as by natural convection provided by the combustion process itself.

It will be understood that the heat-retention elements within a heat exchange section are supported on a suitable gas-permeable grid 46 or the like, or any suitable means such as will allow for gas flow communication into and out of the heat exchange sections 24, 25 and 26.

Figure 2:
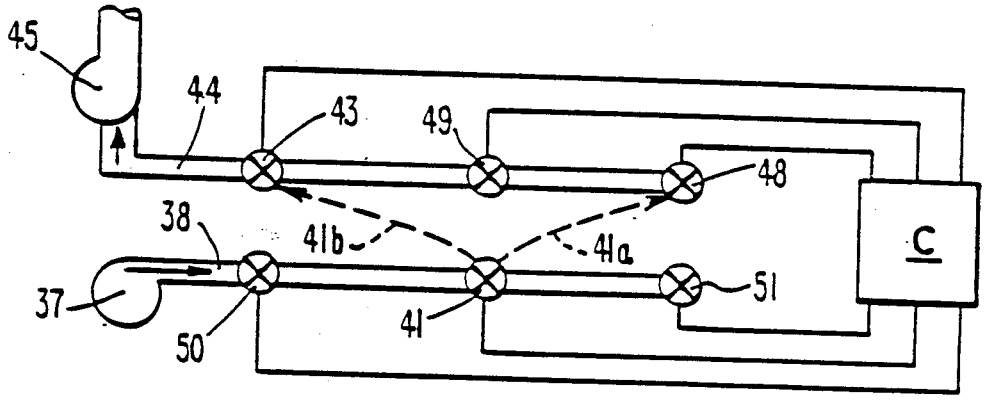
FIG. 2 is a schematic diagram of the gas flow into an inlet manifold, through valves, up through the plenum, heat exchange section and combustion chamber, and back through valve to an outlet manifold duct to discharge, with means connecting the valves to a control apparatus.

With reference to FIG. 2, it will be understood that, incoming flow of gases is schematically shown in the arrangement illustrated, to be through the heat exchange section 25, as shown by the arrows **41*a* and 41*b* in FIG. 2, because the valves 41, 43 and 48 are set in open positions, and the valves 50, 51 and 49 are set in closed positions, such that the gas flow is via arrows 41*a* and 41*b* to exit manifold duct 44. In this regard, it will be understood that valves 41, 43, and 48 are open and that valves 49, 50 and 51 are closed. It will further be understood that after a period of time, when the heat exchange elements no longer have sufficient heat to adequately preheat incoming gases, two or more pairs of valve settings will be reversed, such that gas flow through heat exchange section 25 is reversed, as will be gas flow through at least one of the other heat exchange section 24 or 26 be reversed, by appropriate settings of the incoming and outgoing valves, such that heat exchange elements in section 25 will now absorb heat, from passage of fresh gaseous products of combustion outwardly there through, while heat exchange elements in one or more of the adjacent heat exchange sections 24 or 26** will serve to preheat incoming gases to be the subject of combustion.

It will further be understood that appropriate settings of the valves illustrated in FIG. 2 may be programmably controlled by means of a suitable control circuit "C", which may function in the form of a timed actuation of valves in any desired sequence of valve operation, a computer controlled actuation of valves, or the like, as desired.

It will also be understood that adjacent walls of the inlet and outlet manifold ducts 38 and 44, may be spaced apart as shown by the walls 53 and 54, or the same can be shared, by a common wall, again for reasons of economy of heat transfer and prevention of thermal loss, whereby incoming gases may be preheated to some extent by outgoing gases passing via duct 44.

It will also be apparent that the valves 41, 43, 48, 49, 50 and 51 may take on various forms, such as butterfly valves, poppett valves or the like, and that the same may be either mechanically, hydraulically, pneumatically or electrically driven as desired.

It will further be understood that the upstanding walls 30 and 31 that separate the various heat exchange sections will be non-porous to the passage of gases from one heat exchange, section to another. Likewise, the tray walls, such as those 27 and 28, as well as the walls of the oven 11, will be non-porous to the passage of gases.

Figure 3:
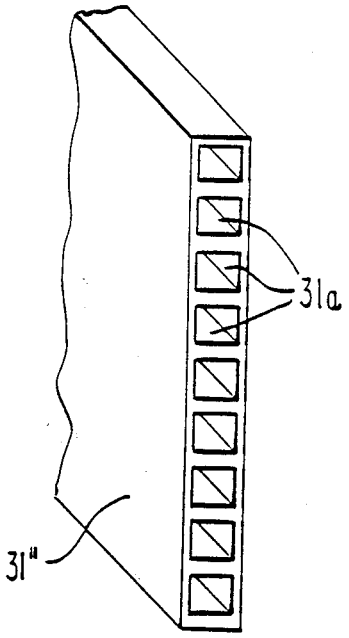
FIG. 3 is a schematic perspective view of an alternative construction for the common separating wall between the adjacent heat exchange sections, in which air flow is permitted laterally within the wall.
Figure 4:
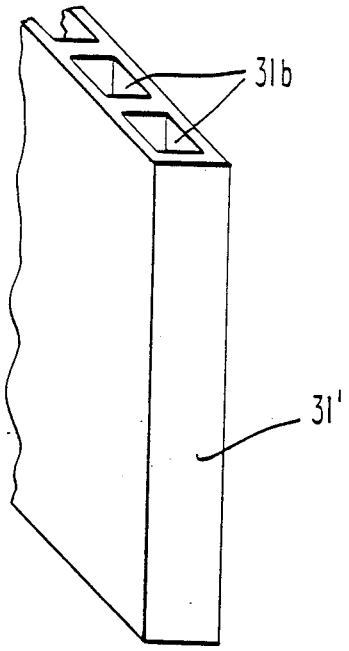
FIG. 4 is a view somewhat to that of FIG. 3, but wherein air flow is permitted vertically through the wall.
Figure 5:
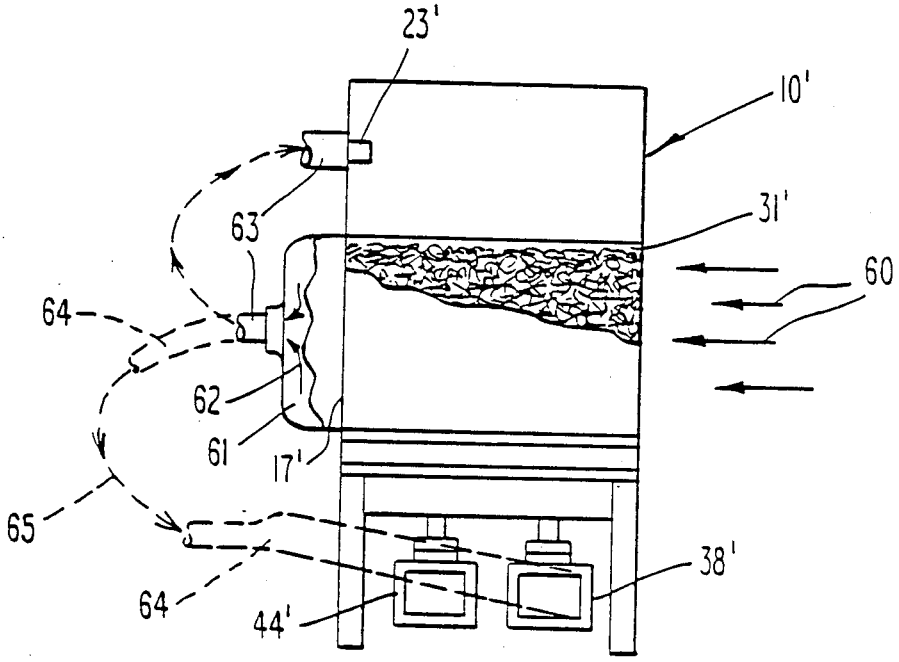
FIG. 5 is a schematic view of air flow through an apparatus having common separation walls between adjacent heat exchange sections, but wherein air flow is schematically illustrated back into the combustion chambers through the burner (in full lines), and alternatively back into the system via the inlet manifold.

With specific reference to FIGS. 3 through 5, modifications are presented whereby the upstanding walls 30 and 31 may be hollow so as to allow the passage of gas (especially air) there through.

For example, with reference to FIG. 3, a wall 31' is shown, having a plurality of transverse conduits **31*a* there through, extending from front to back of the apparatus 10**.

Similarly, FIG. 4 shows a wall 31'', for separating adjacent heat exchange sections, in which the conduits **31*b*** through the wall are vertical, to allow for passage of gas, (especially air) vertically there through.

In either case; i.e., in the wall arrangements of FIGS. 3 or 4, means are provided for cooling the separation walls 30 and 31, for keeping their temperatures sufficiently low that structural deformations are prevented, and for enabling the use of lower cost materials.

For example, when the walls 30 and 31 are to be of metal, for example, steel construction, it may be desirable, depending upon the temperatures that are planned for the adjacent heat exchange sections, to provide a mechanism for cooling the walls, to prevent buckling or the like, especially when the walls are constructed of steels that are not designed for very high temperature use. To this end, incoming air may enter the unit 10' in the direction of arrows 60, to pass through wall 31', after passing through appropriate holes (not shown) in vertical wall 18', to be delivered through back wall 17' also through appropriate holes (not shown), but in which the outlets of the transverse hole conduits **31*a* will enter a manifold 61, to pass in the direction of arrows 62, to be delivered via a suitable conduit 63, into the combustion chamber, by some suitable delivery means, such as by entering through the burner 23'. Alternatively, as shown in phantom in FIG. 5, the outlet air heated by passage through the conduits 31*a* of separation walls, such as wall 31'; may pass from the manifold 61, to a delivery duct 64, shown in phantom, for delivery back into the system as shown by arrows 65, to inlet manifold 38'; in which case the heated air is recycled for efficient re-use of the energy carried thereby, to provide a preheating function for the air. A further alternative, but less desirable, and not specifically shown in FIG. 5, would be to allow the air discharged from the phantom duct 64, to escape to atmosphere, as by being delivered to duct 44'**.

As a further alternative to the arrangements illustrated in FIGS. 3 through 5, the conduits through the walls could be constructed of pipe. Additionally, a fan, blower or the like could be disposed at the front of the wall 18', or as part of the manifold 61 to draw the incoming gasses (for example, air), through the conduits **31*a* (or 31*b***).

It will also be noted that the disposition of the air from the manifold 61 may vary depending upon the temperature at which the unit 10 is operating. For example, if the combustion chamber is operating at a temperature of 2400° F., it may be desirable to inject the air directly into the combustion chamber, as for example, via the delivery conduit 63.

In accordance with the foregoing description of the valving arrangements, such as that shown in FIG. 2 it will be understood that contaminated fumes, odors, or the like that are to be burnt, are enabled to enter the apparatus through the inlet manifold duct, and that the valves are set to direct such gases containing fumes or the like through the heat exchange sections 24, 25 and 26, passing through the stoneware beds at temperatures very close to the incineration temperature. Oxidation is then completed in the upper portion 21 of the oven 11, which comprises the combustion chamber, by means of a gas or oil burner that maintains a preset incineration temperature.

As aforesaid, the gases thus delivered may contain volatile organic components that can auto-ignite, while still in the stoneware, and that if they do, such will facilitate, and make more rapid, the combustion in the upper portion 21 of the combustion chamber. In some situations, the incoming gases may contain enough volatile organic compounds that the energy released can provide all of the heat required for the apparatus and the burner may automatically go to pilot. After the burning is effected in the upper portion 21 of the oven 11 that comprises the combustion chamber, a re-setting of the valves as aforesaid will cause the purified gases to be pulled downwardly through the stoneware beds which are at that time in an "outlet" mode, thereby passing heat to the stoneware which the stoneware absorbs.

In accordance with the present invention, a unit is provided that may be small, and of lightweight construction, for industrial treatment of gases from spray booth, for example, at an exhaust volume of 4000 SCFM or the like, or even at much larger or much smaller volumes, as are desired; agricultural pesticides may be disposed of at high rates of energy recovery; wide ranges of solvents from coating and laminating may be disposed of with a high percentage of thermal energy recovery; emissions from coatings of paper and film may be taken care of at high rates of energy recovery; hydrocarbons and ceramic kiln emissions may be disposed of at high rates of thermal energy recovery; gases from solid waste destruction may be disposed of; gases from residual liquids that are being oxidized or otherwise destroyed may be disposed of; and emissions from various chemical manufacturing processes may be disposed of, again at high rates of thermal energy recovery, as well as many other prospects of treatment in accordance with the present invention.

It will be apparent from the foregoing that various modifications may be made in the details of construction, as well as in the use and operation of the present device, all within the spirit and scope of the invention as claimed. For example, the device may be constructed in any of various sizes, with the heights of the separation walls 30 and 31, of any desired relative height within the chamber such as will effect the desired combustion. Also, the materials of construction of the various components as set forth by way of example herein, are merely examples of those that are preferred, and the same are not intended to be limiting. Also, the unit herein described, while being preferably intended to provide small, lightweight units, can also provide compact and portable larger units, capable of handling up to 100,000 SCFM or more, if desired, although the construction is most feasible for the previously describe smaller, compact units.

Additionally, while in the system shown and described herein, the various heat exchange sections are aligned, in-line, it will be understood that the heat exchange sections could, if desired, be made in any configuration, such as in an "L"-shaped configuration or, a triangular or circular configuration, etc., as may be desired. Furthermore, the unit may be used by itself, or in conjunction with a auxiliary gas burner unit as desired.

What is claimed is:

1. Apparatus for incinerating industrial exhaust gases on a thermal recovery principle, comprising:

(a) an oven having an upper portion and a lower portion;

(b) the upper portion being a combustion chamber having combustion means therein;

(c) the lower portion being comprised of a plurality of heat exchange sections;

(d) the heat exchange sections each having a gas permeable member at a lower end thereof and a pile of refractory heat exchange elements disposed on the gas permeable member in a manner to allow gas flow through the elements;

(e) with adjacent heat exchange sections being separated by a common flow separation wall means;

(f) with separate associated plenum means for each said heat exchange section, located therebeneath and in gas flow communication therewith;

(g) means for delivering a flow of exhaust gases to be incinerated into at least one plenum, upwardly through its associated heat exchange section into the combustion chamber and then delivering the gaseous products of combustion downwardly through another heat exchange section and through its associated plenum means to discharge from the apparatus; including (h) means for alternating the direction of flow through said heat exchange sections and associated said plenum means;

(i) wherein said flow separation wall means includes conduit means therein for conveying gases there through.

2. The apparatus of claim 1, including means for recycling gases that are conveyed through the conduit means, back into the apparatus for delivery to the combustion chamber.

3. The apparatus of claim 2, wherein said recycling means includes means for delivery of the gases to the combustion chamber via the inlet manifold duct means.

4. A self-contained compact apparatus for use in incinerating industrial exhaust gases on a thermal recovery principle, comprising:

(a) an oven having upstanding walls and a top connecting the walls, and having an upper portion and a lower portion;

(b) the upper portion being a combustion chamber and having burner means therein;

(c) the lower portion being comprises of a plurality of heat exchange sections;

(d) the heat exchange sections each having a gas permeable grid member at a lower end thereof, comprising means for supporting heat exchange elements thereon;

(e) with adjacent heat exchange sections being separated by a common flow separation wall means, (f) with separate associated plenum means for each said heat exchange section, located beneath and in gas flow communication therewith;

(g) inlet manifold duct means for delivering gases to said plenum;

(h) outlet manifold duct means for delivering gases from said plenum;

(i) valve means for selectively opening and closing gas flow paths between selected said manifold duct means and selected said plenum means;

(j) common supporting frame means supporting at least said oven and components attached thereto;

(k) wherein the frame comprises a generally horizontal frame member and vertical supporting legs;

(l) wherein said common flow separation wall means includes conduit means therein for conveying gases therethrough, including means for recycling gases that are conveyed through the conduit means back into the apparatus for delivery to the combustion chamber; and (m) wherein said valve means are disposed between said plenum means and said duct means, with said walls and top of the oven being at least partially constructed of a refractory material; and wherein there are at least three said heat exchange sections, aligned in generally straight line relationship;

wherein said plenum means, valve means and manifold duct means are included among the components supported by said frame means.

* * * * *